US005560226A

United States Patent [19]

Throneburg

[11] Patent Number: 5,560,226

[45] Date of Patent: Oct. 1, 1996

[54] FOOT PROTECTOR IN COMBINATION WITH HOSIERY AND METHOD OF KNITTING SAME

[76] Inventor: James L. Throneburg, 625 W. Bell St., Statesville, N.C. 28687

[21] Appl. No.: 371,877

[22] Filed: Jan. 12, 1995

[51] Int. Cl.[6] ..... D04B 1/26; A41B 11/02

[52] U.S. Cl. ..... 66/185; 66/178 R; 2/239

[58] Field of Search ..... 66/178 R, 185, 66/186, 187, 194; 2/239, 240

[56] References Cited

U.S. PATENT DOCUMENTS

| | | | |
|---|---|---|---|
| 1,727,586 | 9/1929 | Condon | 2/61 |
| 1,889,716 | 11/1932 | Walker | 2/61 |
| 2,144,563 | 1/1939 | Davis | 66/182 |
| 2,333,373 | 11/1943 | Grey | 2/239 X |
| 2,391,064 | 12/1945 | McCandless | 2/239 |
| 2,687,528 | 8/1954 | Paul | 2/239 |
| 3,085,410 | 4/1963 | Loizillon | 66/198 X |
| 3,102,271 | 9/1963 | Wilkerson | 2/239 |
| 3,274,709 | 9/1966 | Lipinski | 2/239 X |
| 3,796,067 | 3/1974 | East | 66/178 |
| 4,194,249 | 3/1980 | Throneburg | 2/239 |
| 4,253,317 | 3/1981 | Howard et al. | 66/186 |
| 4,255,949 | 3/1981 | Throneburg | 66/185 |
| 4,263,793 | 4/1981 | Safrit et al. | 66/185 |
| 4,277,959 | 7/1981 | Throneburg | 66/182 |
| 4,341,096 | 7/1982 | Safrit et al. | 66/185 |
| 4,373,361 | 2/1983 | Throneburg | 66/178 R |
| 4,520,635 | 6/1985 | Shields et al. | 2/239 X |
| 4,615,188 | 10/1986 | Hursh et al. | 66/196 |
| 4,732,015 | 3/1988 | Abrams et al. | 66/172 E |
| 5,307,522 | 5/1994 | Throneburg et al. | 2/239 |
| 5,325,541 | 7/1994 | Willard | 2/239 |
| 5,335,517 | 8/1994 | Throneburg et al. | 66/185 |

*Primary Examiner*—John J. Calvert

*Attorney, Agent, or Firm*—Bell, Seltzer, Park & Gibson, P.A.

[57] ABSTRACT

A foot protector in combination with hosiery, such as high fashion women's hosiery, is provided to be worn on a foot of a wearer. The foot protector is designed and constructed to provide cushioning comfort to a ball portion, i.e., bottom or planar areas thereof, of a wearer's foot to concentrate cushioning to where most needed. The foot protector preferably is a knit footlet having integrally knit thickened cushion areas provided only in ball portion areas thereof, whereby other areas of the footlet are not thickened to such an amount as to make a shoe feel undersized and tight on a wearer's foot. The knit thickened cushion areas have terry loops integrally knit only in a ball portion of the footlet and are so constructed as to underlie only a corresponding ball portion of a wearer's foot. A method of forming a foot protector arranged to be positioned over a wearer's foot is also provided which includes knitting at least one body yarn to form at least heel, arch, ball and toe portions and define a footlet and integrally knitting terry loops with the one body yarn only in the ball portion of the footlet. A method of wearing a foot protector over a wearer's foot and underneath other hosiery is further provided and includes positioning knit thickened cushion areas of terry loops integrally knit only in ball portion areas of a footlet so as to underlie and intimately contact only a ball portion of a wearer's foot.

37 Claims, 3 Drawing Sheets

FOOT PROTECTOR IN COMBINATION WITH HOSIERY AND METHOD OF KNITTING SAME

FIELD OF THE INVENTION

This invention relates generally to hosiery and, more particularly, to a foot protector in combination with hosiery.

BACKGROUND OF THE INVENTION

Many types of women's shoes are available on the market including casual and dress heeled shoes, i.e., women's pumps. These casual and dress heeled shoes generally have an innersole which forms a flat surface extending throughout ball and lower toe portions thereof, an upwardly inclined surface extending throughout an arch portion toward a heel portion, and a flat surface extending throughout major areas of the heel portion. The heel portion of the sole of the shoes is generally raised relative to the ball and toe portions and is supported by an outersole having various height and width heels.

A common problem with these type of women's heeled shoes is that when wearing these shoes the wearer's weight is shifted primarily toward the ball and lower toe portions of the wearer's foot and the underlying ball and toe portions of the shoe. The ball portion of a foot generally receives a majority of the normal pressures of a foot and, more particularly, a metatarsal region of the ball portion of the foot. Accordingly, wearing these type of women's shoes for an extensive period of time, for example, may cause soreness, callouses, and possibly even foot damage to the wearer.

Women also generally wear nylon stockings or other hosiery with these heeled shoes. Although developments have been made at protecting the stockings when positioned on the foot of a wearer, such as seen in U.S. Pat. No. 1,727,586 by Condon titled "*Stocking Protector*" and U.S. Pat. No. 1,889,716 by Walker titled "*Hosiery Protector*", these stocking protectors fail to provide any type of cushioning protection for the wearer's foot.

Additionally, most women's shoes are designed more with an eye to fashion, and usually at the expense of comfort. This is increasingly clear in view of trends whereby shoe manufacturers design the woman's shoe itself to provide more comfort. Nevertheless, these shoe manufacturers have not been very successful with instituting comfort, yet still maintaining eye appeal.

OBJECTS AND SUMMARY OF THE INVENTION with the foregoing in mind, it is an object of the present invention to provide a source of comfort, in the form of a foot protector positioned on a foot of a wearer and underneath hosiery that can be worn with any woman's shoe such that women do not have to forego fashion for comfort.

It is another object of the present invention to provide a foot protector in combination with hosiery worn on a foot of a wearer wherein the foot protector provides cushioning comfort to a ball portion of the wearer's foot.

It is yet another object of the present invention to provide a foot protector arranged to be positioned over a wearer's foot and underneath a wearer's stocking to reduce wear and tear and to provided cushioning comfort to a ball portion, and more particularly a metatarsal region thereof, of a wearer's foot.

It is a further object of the present invention to provide methods of forming and wearing a foot protector arranged to be positioned over a wearer's foot and underneath hosiery to thereby reduce wear and tear and provide cushioning comfort to a ball portion of a wearer's foot More particularly, a foot protector in combination with hosiery is provided to be worn on a foot of a wearer. Because ball portion areas of a foot generally receives a majority of the pressures and forces experienced by a foot and, more particularly, a metatarsal region of the ball portion of a foot, the foot protector provides cushioning comfort to ball portion areas, i.e., bottom or plantar areas thereof, of a wearer's foot to concentrate cushioning where most needed. The foot protector preferably is a knit footlet having thickened cushion areas provided only in ball portion areas thereof, whereby other areas of the footlet, i.e., arch, instep, are not thickened to such an amount as to make a shoe feel undersized and tight when positioned on a wearer's foot. The thickened cushion areas preferably have terry loops integrally knit only in ball portions of the footlet and are so constructed as to underlie only a corresponding bottom or plantar area of a ball portion of a wearer's foot.

Also, according to the present invention, a combination of hosiery is arranged to be worn on a foot of a wearer to reduce wear and tear and provide cushioning comfort to bottom or plantar areas of a ball portion of a wearer's foot. The hosiery preferably includes a footlet positioned on a foot of a wearer and a knit stocking positioned to contact and envelop the footlet positioned on the foot of the wearer. The footlet preferably has at least one body yarn knit throughout at least heel, arch, ball, and toe portions to thereby collectively define the footlet, and at least one set of terry loops integrally knit with the one body yarn only in the ball portion of the footlet. The terry loops are arranged to contact and underlie bottom or planar areas of a ball portion, i.e., including metatarsal heads, of the wearer's foot and provide cushioning comfort thereto.

Additionally, according to the present invention, a knit foot protector is provided and arranged to be worn on a foot of a wearer in intimate contact with the wearer's skin for providing cushioning comfort to a ball portion of a wearer's foot and for reducing wear and tear on a wearer's foot. The foot protector is formed of a knit fabric and preferably has at least one body yarn knit throughout at least heel, arch, ball, and toe portions so as to define a footlet, and terry loops integrally knit with the one body yarn only in the ball portion of the footlet. The terry loops, i.e., preferably two sets of terry loops, are arranged to intimately contact and underlie a ball portion of a wearer's foot for providing cushioning comfort thereto.

A method of forming a foot protector, according to the present invention, arranged to be positioned over a wearer's foot and underneath hosiery to thereby reduce wear and tear and provide cushioning comfort to a ball portion of a wearer's foot is also provided. The method preferably includes knitting at least one body yarn to form heel, arch, ball and toe portions and to define a footlet, and integrally knitting terry loops with the one body yarn only in the ball portion areas of the footlet.

Further, a method of wearing a foot protector over a wearer's foot and underneath hosiery to thereby reduce wear and tear and to provide cushioning comfort to a ball portion of a wearer's foot is also provided. The method preferably includes positioning knit thickened cushion areas of terry loops integrally knit only in a ball portion of a footlet so as to underlie and intimately contact only a corresponding ball portion of a wearer's foot. The method further includes positioning hosiery to contact and envelop the footlet positioned on the foot of a wearer.

BRIEF DESCRIPTION OF THE DRAWINGS

Other objects and advantages will appear as the description proceeds when taken in connection with the accompanying drawings, in which.

DETAILED DESCRIPTION

The present invention now will be described more fully hereinafter with reference to the accompanying drawings, in which preferred embodiments of the invention are shown. This invention may, however, be embodied in many different forms and should not be construed as limited to the illustrated embodiments set forth herein; rather, these illustrated embodiments are provided so that this disclosure will be thorough and complete, and will fully convey the scope of the invention to those skilled in the art. Like numbers refer to like elements throughout.

Figures 1, 2:
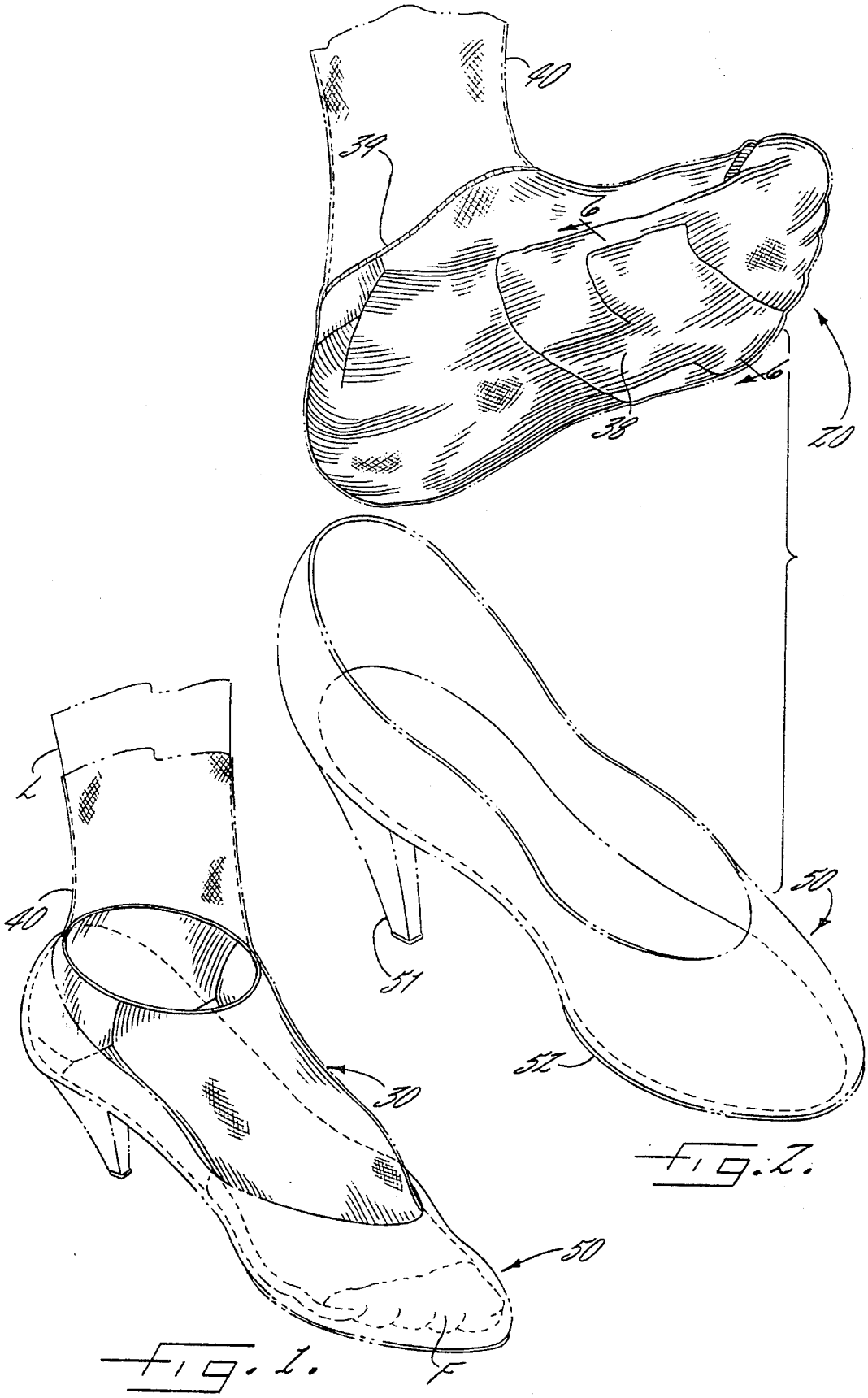
FIG. 1 illustrates a perspective view of a leg and a foot of a wearer having a foot protector positioned over the wearer's foot, underneath hosiery, i.e., a knit stocking, and in a woman's shoe according to the present invention.
FIG. 2 illustrates an exploded perspective view of a foot protector in combination with hosiery positioned on a foot of a wearer according to the present invention.

As illustrated in FIGS. 1–4, the present invention provides a foot protector 30 in combination with hosiery 40 worn on a foot F of a wearer. FIGS. 1 and 2 illustrate a leg L and a foot F of a wearer having the combination 20 of a foot protector 30 positioned over the wearer's foot and underneath hosiery 40, and further positioned in a woman's shoe 50, illustrated in the form a heeled shoe or pump, according to the present invention. The foot protector 30 preferably is designed and constructed to provide cushioning comfort primarily only to a bottom or planar surface of a ball portion of the wearer's foot , F and also as needed to peripheral areas of a bottom or a planar surface of a metatarsal region and a phalanges region of a wearer's foot. It is understood that the ball portion of a foot generally receives a majority of the pressures and forces experienced by a foot F and, more particularly, a metatarsal region of the ball portion of the foot F. For example, wearing women's heeled shoes for extensive periods of time may cause pain, soreness, callouses, bunions, hammer toes, and other possible foot damage to the wearer. It will also be understood that various other shoes, i.e., casual or athletic shoes, may be used as well. Accordingly, a foot protector 30 according to the present invention addresses the problem of wear and tear received by pressures and forces on a wearer's foot by providing cushioning comfort primarily only to a corresponding ball portion of the wearer's foot F to concentrate cushioning where most needed and reduce the wear and tear on this portion of the foot F caused by various pressures and forces thereagainst.

Figure 3:
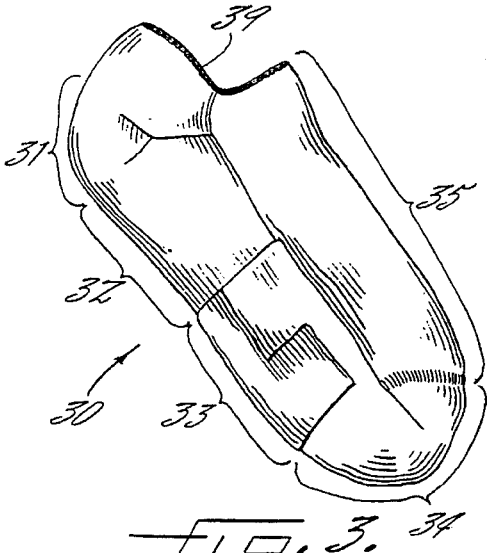
FIG. 3 illustrates a side elevational view of a foot protector in the form of a footlet according to the present invention.
Figure 4:
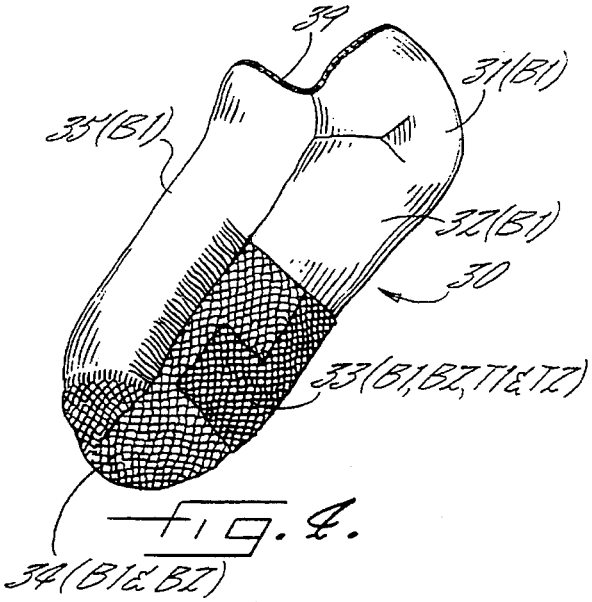
FIG. 4 illustrates a side elevational view of a foot protector in the form of a footlet in an everted position according to the present invention.

As best illustrated in FIGS. 2–4, the foot protector preferably is a knit footlet 30 having thickened cushion areas provided only in ball portion areas 38 thereof, whereby other areas of the footlet 30 are not thickened to such an amount as to make a shoe 50 feel undersized and tight when positioned on a wearer's foot F. The thickened cushion areas 38 are preferably formed of terry loops T1, T2 integrally knit only in a ball portion 33 of the footlet 30 and so constructed as to intimately contact and underlie only a ball portion of the wearer's foot F. It will also be understood by those skilled in the art that other types of thickened cushion areas may also be provided according to the present invention, such as pads stitched to or integrally formed with inner ball portion areas of the footlet 30.

The knit footlet 30 is also preferably formed of a colored yarn 81, corresponding to the color of the hosiery 40 or to the skin color of the foot, such that the footlet 30 is not readily visible when positioned on the foot F of a wearer and underneath the hosiery 40, i.e., nylon knit stocking. This feature of the invention provides the advantage of allowing women to wear fashionable shoes and fashionable stockings on various occasions and still receive the cushioning comfort of the present invention during usage or wear of the footlet 30.

The other knit and less thickened areas of the knit footlet 30 preferably include heel 31, arch 32, toe 34, and instep 35 portions. The heel 31, arch 32, ball 33, toe 34, and instep 35 portions preferably are knit of at least one body yarn, i.e., a first body yarn B1. The first body yarn B1 is preferably formed of nylon. As best illustrated in FIGS. 3–8, a second body yarn B2 preferably is also integrally knit only in the ball 33 and toe 34 portions of the knit footlet 30 to provide additional protection and reinforcement to areas of the footlet 30 receiving the most wear and tear (see FIG. 4). The second body yarn B2 is also preferably formed of nylon. The terry loops T1, T2 preferably include at least two sets of raised or upstanding terry loops T1, T2 integrally knit with the first and second body yarns B1, B2 only in the ball portion 33 of the footlet 30 as illustrated. The sets of raised terry loops T1, T2 are arranged to intimately contact and underlie a ball portion of the wearer's foot F and provide cushioning comfort thereto (see FIGS. 2 and 5). Also, according to the present invention, the second body yarn B2 preferably is formed of a hydrophilic yarn to further absorb moisture in ball 33 and toe 34 portions of the wearer's foot F.

As best illustrated in FIGS. 2 and 3, the Knit footlet 30 also preferably has an elastomeric member 39 positioned in an upper peripheral portion of the knit heel 31 and instep 35 portions. The elastomeric member 39 is arranged for firmly positioning the upper peripheral portion of the footlet 30 closely adjacent corresponding upper peripheral portions of the wearer's foot F.

Figure 5:
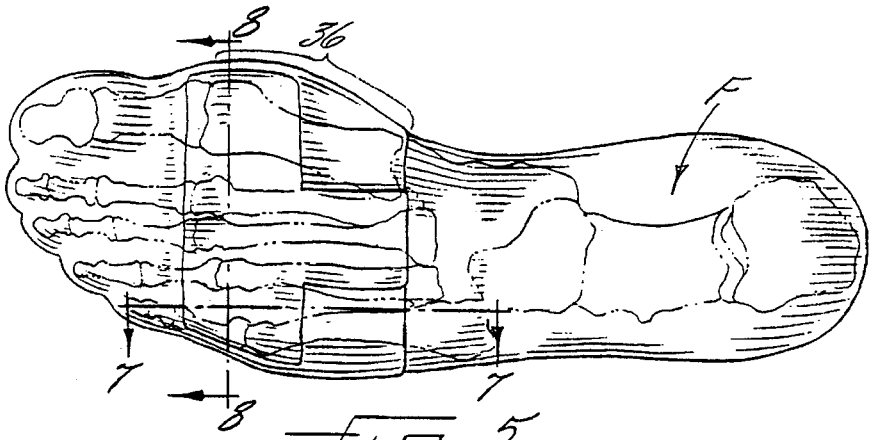
FIG. 5 illustrates a bottom plan view of a foot protector according to the present invention positioned on a foot of a wearer, the bones of the wearer's foot being shown in phantom view.
Figure 6:
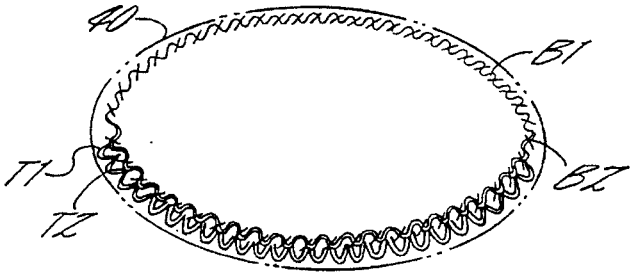
FIG. 6 illustrates an enlarged cross-sectional view of a foot protector having hosiery enveloping the same according to the present invention taken substantially along line 6—6 of FIG. 2.
Figure 7:
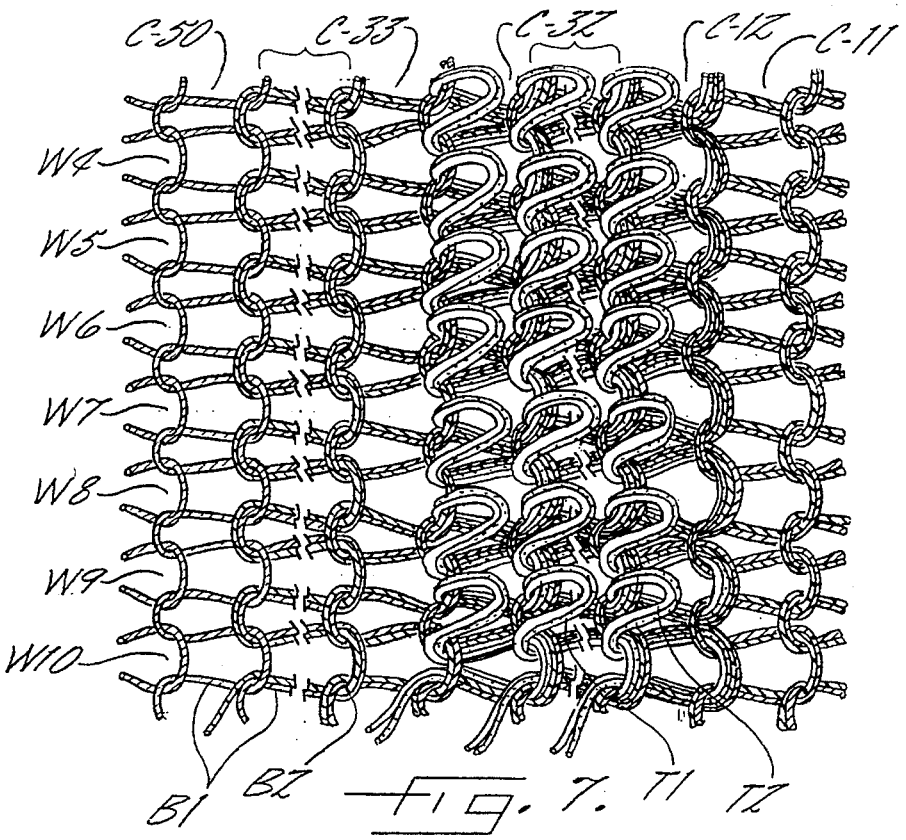
FIG. 7 illustrates a greatly enlarged fragmentary view of a foot protector in the form of a footlet according to the present invention taken substantially along line 7—7 of FIG. 5.
Figure 8:
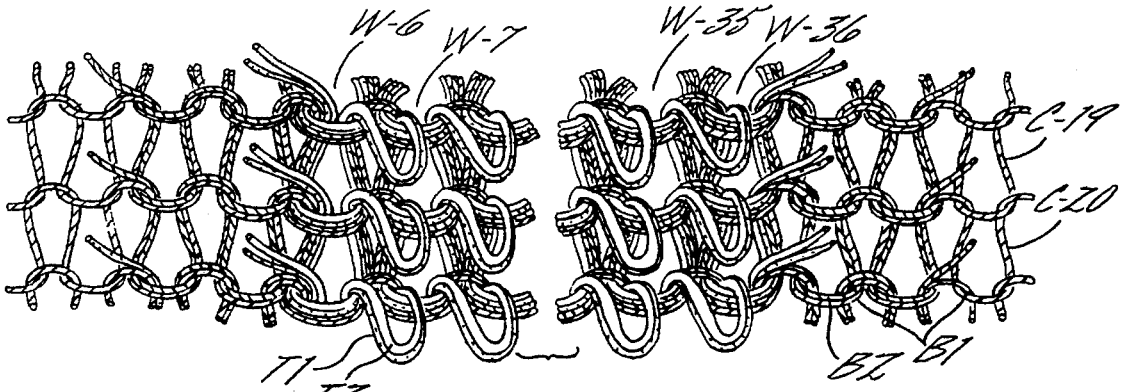
FIG. 8 illustrates a greatly enlarged fragmentary view of a foot protector in the form of a footlet according to the present invention taken substantially along line 8—8 of FIG. 5.

FIG. 5 illustrates a bottom plan view of a foot protector 30 according to the present invention positioned on a foot F of a wearer. As understood by those skilled in the art, the bones of the wearer's foot F are shown in phantom view. The bones of the foot F generally include the heel or calcaneus bone positioned beneath the talus bone and at the lower end of the tibia (not shown) as well as the navicular, the cuneiform, the metatarsals, the phalanges, and the toe bones. As best illustrated in FIG. 5, the ball portion 33 of the knit footlet 30 preferably includes a metatarsal region 36. The terry loops T1, T2 are preferably integrally knit in at least the metatarsal region 36, i.e., metatarsal head region, of the ball portion 33 to particularly concentrate cushioning where most needed. It will be understood by those skilled in the art, however, that other portions of the ball portion 33, i.e, preferably including phalanges region or base of proximal phalanges, of a footlet 30 according to the present invention may also include integrally knit terry loops. As also understood by those skilled in the art, the base of the phalanges region according to the present invention preferably form a portion of the ball portion, but may also be considered by some to include peripheral edges of the toe portion of a footlet 30. The terry loops T1, T2 integrally knit only in the ball portion 33 of the footlet 30 preferably are integrally knit throughout major portions of a lateral extent of the ball portion 33 and preferably have a range between 2 to 40 wales W and between 2 to 40 courses C thereof (see FIGS. 7 and 8). The range may vary with factors such as footlet size and the desired shape and size of the knit thickened cushion areas thereof.

As best illustrated in FIGS. 2 and 5, thickened cushion areas or the sets of terry loops T1, T2 of the ball portion 33 of the knit footlet 30 according to the present invention preferably form a predetermined configuration such as a shape, design, character, symbol, number, designation of origin, trademark, orientation, or the like along inner and/or outer portions of the footlet 30. This configuration creatively may designate origin of the footlet 30 or provide other colorful features to the producer, seller, or user thereof. In the illustrated embodiment, the sets of terry loops T1, T2 are integrally knit only in substantially longitudinal and lateral intersecting portions 38 of the ball portion and substantially form an overall shape of the alphanumeric letter "T". The lateral portion of the "T" shape extends only in the metatarsal region of the ball portion and the longitudinal portion of the "T" extends a predetermined length from the metatarsal region toward the arch portion 32 of the footlet 30, and if desired into lower peripheral portions of the arch portion as understood by those skilled in the art. The two sets of terry loops T1, T2 preferably form a shock absorber type cushion generally in the shape of a "T" such as when averted (FIG. 4), but may also comprise various other shapes, i.e., rectangular or oval, as well.

As illustrated in FIGS. 4 and 6–8, a method of forming a foot protector arranged to be positioned over a wearer's foot F and underneath hosiery 40, i.e., stockings, to thereby reduce wear and tear and to provide cushioning comfort to a ball portion of a wearer's foot F is also provided according to the present invention. The method preferably includes knitting at least one body yarn B1 to form at least heel 31, arch 32, ball 33 and toe 34 portions, and preferably also an instep portion 35, and to define a footlet 30 and integrally knitting terry loops T1, T2 with the one body yarn B1 only in the ball portion 33 of the footlet 30. The one body yarn may also be a first body yarn B1, and wherein the method further includes integrally knitting a second body yarn B2 with the first body yarn B1 only in the ball 33 and toe 34 portions of the footlet 30. The step of knitting terry loops T1, T2 may further include knitting two sets of terry loops only in a metatarsal region 36 of the ball portion 33 of the footlet 30, as illustrated in FIG. 5.

A method of wearing a foot protector 30 over a wearer's foot F and underneath hosiery 40 is also provided according to the present invention to thereby reduce wear and tear and to provide cushioning comfort to a ball portion of a wearer's foot F. The method preferably includes positioning knit thickened cushion areas of terry loops T1, T2 integrally knit only in a ball portion 33 of a footlet 30 so as to underlie and intimately contact only a corresponding ball portion of a wearer's foot F. The ball portion of a wearer's foot F preferably includes at least portions of the metatarsals, and also preferably the juncture region of the metatarsals and the phalanges. The method further includes positioning hosiery 40 to contact and envelop the footlet 30 positioned on the foot F of a wearer.

In the drawings and specification, there have been disclosed typical preferred embodiments of the invention and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A combination of hosiery arranged to be worn on a foot to provide cushioning comfort to a ball portion of the foot, the combination of hosiery comprising:

a knit stocking arranged to be positioned over the foot; and a foot protector having toe, ball, heel and instep or outstep portions which encompass at least part of the ball and instep or outstep portions of the foot positioned between said knit stocking and the foot to provide cushioning comfort to the ball portion of the foot, the foot protector comprising a knit footlet having thickened cushion areas provided in at least the ball portion area thereof, whereby other area of the footlet are not thickened to such an amount as to make a shoe feel undersized and tight on the foot.

2. A foot protector in combination with hosiery as defined by claim 1, wherein said ball portion area of said knit footlet includes a metatarsal region and wherein said terry loops are integrally knit only in said metatarsal region of said ball portion to particularly concentrate cushioning where most needed.

3. A foot protector in combination with hosiery as defined by claim 1, wherein said footlet is formed of a colored yarn corresponding to a color of the hosiery such that said footlet is not readily visible when positioned on the foot and underneath the hosiery.

4. A foot protector in combination with hosiery as defined by claim 1, wherein said thickened cushion areas comprise terry loops integrally knit only in the ball portion of said footlet and so constructed so as to underlie at least part of the corresponding ball portion of the foot, said terry loops being integrally knit only in said ball portion of said footlet having a range between 2 to 40 wales and between 2 to 40 courses thereof.

5. A foot protector in combination with hosiery as defined by claim 4, wherein said terry loops of said footlet are integrally knit throughout major portions of a lateral extent of said ball portion of said footlet to provide cushioning comfort thereto.

6. A foot protector in combination with hosiery as defined by claim 5, wherein other areas of said footlet comprise a least one of the following: heel, arch, toe, and instep portions, and wherein said heel, arch, ball, toe, and instep portions are knit of at least one body yarn.

7. A foot protector in combination with hosiery as defined by claim 1, wherein said thickened cushion areas form a predetermined configuration.

8. A combination of hosiery arranged to be worn on a foot to provide cushioning comfort to a ball portion of the foot, the hosiery comprising: a footlet positioned on the foot;

a knit stocking positioned to contact and envelop said footlet positioned on the foot;

said footlet including at least one body yarn knit throughout at least heel, arch, ball, instep or outstep, and toe portions and collectively defining said footlet, and at least one set of terry loops integrally knit with said one body yarn only in said ball portion of said footlet, said set of terry loops being arranged to contact and underlie at least part of a bottom area of the ball portion of the foot and provide cushioning comfort thereto.

9. A combination of hosiery as defined by claim 8, wherein said ball portion of said footlet includes a metatarsal region and a phalanges region and wherein said set of terry loops is a set of raised terry loops integrally knit with said one body yarn only in said metatarsal and phalanges regions of said ball portion to particularly concentrate cushioning to where most needed.

10. A combination of hosiery as defined by claim 8, wherein said set of terry loops of said ball portion of said footlet is a set of raised terry loops integrally knit with said one body yarn in a range between 2 to 40 wales and between 2 to 40 courses thereof.

11. A combination of hosiery as defined by claim 8, wherein said set of terry loops of said footlet is a set of raised terry loops integrally knit with said one body yarn throughout major portions of a lateral extent of said ball portion of said footlet to provide cushioning comfort thereto.

12. A combination of hosiery as defined by claim 8, wherein said set of terry loops of said ball portion of said footlet is a set of raised terry loops integrally knit only in substantially longitudinal and lateral intersecting portions of said ball portion and substantially form an overall shape of a "T", and wherein said lateral portion of said "T" shape extends only in a metatarsal region of said ball portion and said longitudinal portion of said "T" extends a predetermined length from said metatarsal region toward said arch portion of said footlet.

13. A combination of hosiery as defined by claim 8, wherein said one body yarn of said footlet is formed of nylon and colored such that said footlet is not readily visible when positioned on the foot and underneath said knit stocking.

14. A combination of hosiery as defined by claim 8, wherein terry loops are also integrally knit in peripheral areas of said arch portion so as to underlie a phalanges region thereof.

15. A combination of hosiery as defined by claim 14, wherein said footlet further comprises an elastomeric member positioned in an upper peripheral portion of said knit heel and instep portions, said elastomeric member being arranged for firmly positioning said upper peripheral portion of said footlet closely adjacent corresponding upper peripheral portions the foot.

16. A combination of hosiery as defined in claim 8, wherein said at least one body yarn of said footlet comprises a first body yarn, wherein said footlet further comprises a second body yarn integrally knit with said first body yarn only in said ball and toe portions of said footlet, and wherein said at least one set of terry loops is a set of raised terry loops integrally knit with said first and second body yarns only in said ball portion of said footlet, said at least one set of raised terry loops being arranged to intimately contact and underlie bottom areas of the ball portion of the foot and provide cushioning comfort thereto.

17. A combination of hosiery as defined by claim 16, wherein said second body yarn is formed of a hydrophilic yarn to absorb moisture in ball and toe portions of the foot.

18. A knit foot protector arranged to be worn on the foot in intimate contact therewith for providing cushion comfort to a ball portion of the foot, the foot protector being formed of a knit fabric and comprising a least one body yarn knit throughout at least heel, arch, ball, instep or outstep and toe portions so as to define a footlet, and terry loops integrally knit with said one body yarn only in said ball portion of said footlet, said terry loops being arranged to intimately contact and underlie at least part of the ball portion of the foot for providing cushioning comfort thereto.

19. A knit foot protector as defined by claim 18, wherein said ball portion of said footlet includes a metatarsal region and wherein said terry loops are integrally knit with said one body yarn only in said metatarsal region to particularly concentrate cushioning comfort to where most needed.

20. A knit foot protector as defined by claim 18, wherein said terry loops are integrally knit with said one body yarn only in said ball portion and have a range between 2 to 40 wales and between 2 to 40 courses thereof.

21. A knit foot protector as defined by claim 18, wherein said terry loops are integrally knit with said one body yarn throughout major portions of a lateral extent of said ball portion of said footlet to provide cushioning comfort thereto.

22. A knit foot protector as defined by claim 18, wherein said terry loops of said ball portion are integrally knit only insubstantially longitudinal and lateral intersecting portions of said ball portion and substantially form an overall shape of a "T", and wherein said lateral portion of said "T" shape extends only in a metatarsal region of said ball portion and said longitudinal portion of said "T" extends a predetermined length from said metatarsal region toward said arch portion of said footlet.

23. A knit foot protector as defined by claim 18, wherein said one body yarn is formed of nylon and colored such that said footlet is not readily visible when positioned underneath a stocking.

24. A knit foot protector as defined by claim 18, wherein said one body yarn is further knit to form an instep portion of said footlet.

25. A knit foot protector as defined by claim 23, wherein said footlet further comprises an elastomeric member positioned in an upper peripheral portion of said knit heel and instep portions, said elastomeric member being arranged for firmly positioning said upper peripheral portion of said footlet closely adjacent corresponding upper peripheral portions of the foot.

26. A knit foot protector arranged to be worn on a foot in intimate contact therewith for providing cushion comfort to a ball portion of the foot, the foot protector being formed of a knit fabric and comprising a first body yarn knit to form heel, arch, ball, toe and instep portions so as to define a footlet, a second body yarn knit integral with said first body yarn only in said ball and toe portions of said foot, and at least two sets of terry loops integrally knit with said first and second body yarns only in said ball portion of said footlet, said two sets of terry loops being arranged to intimately contact and underlie at least a portion of the bottom areas of the ball portion of the foot for providing cushioning comfort thereto.

27. A knit foot protector as defined by claim 26, wherein said ball portion of said footlet includes a metatarsal region and a phalanges region and wherein said two sets of terry loops are raised terry loops integrally knit with said first and second body yarns only in said metatarsal and phalanges regions of said foot to concentrate cushioning comfort where most needed.

28. A foot protector as defined by claim 26, wherein said two sets of terry loops are raised terry loops integrally knit with said first and second body yarns throughout major portions of a lateral extent of said ball portion of said footlet to provide cushioning comfort thereto and having a range between 2 to 40 wales and 2 to 40 courses therein.

29. A knit foot protector as defined by claim 26, wherein said two sets of terry loops of said ball portion are raised terry loops integrally knit only in substantially longitudinal and lateral intersecting portions of said ball portion and substantially form an overall shape of a "T", and wherein said lateral portion of said "T" shape extends only in a metatarsal region of said ball portion and said longitudinal portion of said "T" extends a predetermined length from said metatarsal region toward said arch portion of said footlet.

30. A knit foot protector as defined by claim 26, wherein said first body yarn is formed of nylon and colored such that said footlet is not readily visible when positioned underneath a stocking.

31. A knit foot protector as defined by claim 26, wherein said second body yarn is formed of a hydrophilic yarn and is arranged to absorb moisture in ball and toe portions of the foot.

32. A knit foot protector as defined by claim 26, wherein said footlet further comprises an elastomeric member positioned in an upper peripheral portion of said knit heel and instep portions, said elastomeric member being arranged for firmly positioning said upper peripheral portion of said footlet closely adjacent corresponding upper peripheral portions of the foot.

33. A method of forming a foot protector arranged to be positioned over a foot and underneath hosiery to thereby provide cushioning comfort to a ball portion of the foot, the method comprising:

knitting at least one body yarn to form at least heel, arch, ball, instep and toe portions and define a foolet; and integrally knitting terry loops with the one body yarn only in the ball portion of the footlet.

34. A method as defined by claim 33, wherein said one body yarn comprises a first body yarn, and wherein the method further comprises integrally knitting a second body yarn with the first body yarn only in the ball and toe portions of the footlet.

35. A method as defined in claim 33, wherein the step of integrally knitting terry loops comprises knitting two sets of terry loops only in a metatarsal region of the ball portion of the footlet.

36. A method of wearing a foot protector for encompassing the foot including an instep or outstep portion and ball portion thereof underneath hosiery to thereby provide cushioning comfort to the ball portion of the foot, the method comprising positioning knit thickened cushion areas of terry loops integrally knit only in at least an area of the ball portion of a footlet so as to underlie and intimately contact at least the ball portion of the foot.

37. A method as defined by claim 36, further comprising positioning hosiery to contact and envelop the footlet positioned on the foot.

* * * * *

UNITED STATES PATENT AND TRADEMARK OFFICE
CERTIFICATE OF CORRECTION

PATENT NO. : 5,560,226

DATED : October 1, 1996

INVENTOR(S) : James L. Throneburg

It is certified that error appears in the above-identified patent and that said Letters Patent is hereby corrected as shown below:

Column 1, line 53, please delete "with" and insert -- With --.

Column 1, line 65, please delete "provided" and insert -- provide --.

Column 2, line 5, after "foot" please insert -- . --.

Column 2, line 35, please delete "planar" and insert -- plantar --.

Column 3, line 62, please delete "planar" and insert -- plantar --.

Column 3, line 63, please delete ", F" and insert -- F, --.

Column 3, line 64, please delete "planar" and insert -- plantar --.

Column 3, line 66, after "foot" please insert -- F --.

Column 4, line 61, please delete "Knit" and insert -- knit --.

Column 5, line 51, please delete "averted" and insert -- everted --.

Column 5, line 55, after "protector" please insert -- 30 --.

UNITED STATES PATENT AND TRADEMARK OFFICE

CERTIFICATE OF CORRECTION

PATENT NO. : 5,560,226

DATED : October 1, 1996

INVENTOR(S) : James L. Throneburg

It is certified that error appears in the above-identified patent and that said Letters Patent is hereby corrected as shown below:

Column 6, line 41, please delete "other area" and insert -- other areas --.

Column 7, line 2, please delete "a" and insert -- at --.

Column 7, line 11, please begin new indented paragraph after "comprising:".

Column 7, line 63, after "portions" please insert -- of --.

Column 8, line 14, please delete "a least" and insert -- at least --.

Column 8, line 36, please delete "insubstantially" and insert -- in substantially --.

Column 8, lines 47-49, please delete Claim 24--.

UNITED STATES PATENT AND TRADEMARK OFFICE

CERTIFICATE OF CORRECTION

PATENT NO. : 5,560,226

DATED : October 1, 1996

INVENTOR(S) : James L. Throneburg

It is certified that error appears in the above-indentified patent and that said Letters Patent is hereby corrected as shown below:

Column 10, line 10, please delete "foolet" and insert-- footlet--.

Signed and Sealed this

Sixth Day of May, 1997

*Attest:*

*Attesting Officer*

BRUCE LEHMAN

*Commissioner of Patents and Trademarks*